US006554131B1

(12) United States Patent
Findle et al.

(10) Patent No.: US 6,554,131 B1
(45) Date of Patent: Apr. 29, 2003

(54) THERMOFORMED HEADER PACKAGE FOR TOOL BELT ACCESSORIES AND RELATED PRODUCTS

(75) Inventors: Daniel G. Findle, White Hall, MD (US); David F. Vock, Cockeysville, MD (US); Matthew J. Holland, Baltimore, MD (US); Rajiv N. Dharap, Tai Po (HK)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/656,710

(22) Filed: Sep. 7, 2000

(51) Int. Cl.[7] ..... B65D 73/00

(52) U.S. Cl. ..... 206/296; 206/372; 206/459.5; 206/493; 206/806

(58) Field of Search ..... 206/292, 294, 206/296, 297, 461, 466, 554, 767, 806, 459.5, 372, 373, 493

(56) References Cited

U.S. PATENT DOCUMENTS

| | | | | | |
|---|---|---|---|---|---|
| 349,239 | A | | 9/1886 | Taylor | |
| 3,116,829 | A | | 1/1964 | Pacelli | |
| 3,463,309 | A | | 8/1969 | Szostek | |
| 3,881,257 | A | | 5/1975 | Chasen | |
| 3,918,576 | A | * | 11/1975 | Taub | 206/767 |
| 4,001,957 | A | | 1/1977 | de Lima Castro | |
| 4,016,972 | A | | 4/1977 | Szamborski | |
| 4,165,572 | A | | 8/1979 | Sussman | |
| 4,168,002 | A | | 9/1979 | Crosby | |
| 4,211,329 | A | | 7/1980 | Braverman | |
| 4,449,629 | A | | 5/1984 | Barrieau | |
| 4,512,474 | A | | 4/1985 | Harding | |
| 4,542,827 | A | * | 9/1985 | Pitzer | 206/806 |
| 4,653,642 | A | * | 3/1987 | Hakun et al. | 206/461 |
| 4,666,037 | A | | 5/1987 | Weissman | |
| 4,739,883 | A | | 4/1988 | Mohs et al. | |
| 4,765,472 | A | * | 8/1988 | Dent | 206/373 |
| 4,807,806 | A | * | 2/1989 | Neiman | 206/466 |
| 5,090,570 | A | * | 2/1992 | Todd | 206/806 |
| 5,121,835 | A | | 6/1992 | Grupe | |
| 5,148,618 | A | | 9/1992 | Brewster | |
| 5,263,586 | A | | 11/1993 | Keable | |
| 5,293,993 | A | | 3/1994 | Yates, Jr. et al. | |
| 5,390,794 | A | * | 2/1995 | Vulpitta | 206/461 |
| 5,497,882 | A | | 3/1996 | Kenyon | |
| 5,540,324 | A | | 7/1996 | Knapp | |
| 5,593,036 | A | | 1/1997 | Dyble et al. | |
| 5,626,226 | A | | 5/1997 | Gardiner et al. | |
| 5,699,913 | A | | 12/1997 | Richardson | |
| 5,788,080 | A | * | 8/1998 | Sill et al. | 206/554 |
| 5,927,660 | A | * | 7/1999 | McNerney et al. | 206/554 |
| D422,496 | S | | 4/2000 | Eckmann | |
| 6,116,424 | A | * | 9/2000 | Leu | 206/806 |

* cited by examiner

*Primary Examiner*—Jim Foster
(74) *Attorney, Agent, or Firm*—Harness, Dickey & Pierce, P.L.C.

(57) ABSTRACT

A thermoformed display device is provided for tool belts and accessories. The display device includes a main header which extends beyond the top of the product being packaged and folds over onto itself and snaps together to trap a printed insert display card within a display chamber. The header portion includes performed hang holes for use with various merchandising systems including pegboard. The second thermoformed header piece consists of a flat sheet that slips through the belt loop portion of the product being packaged and is fastened to the main header by means of plastic push-type fasteners to securely fasten the two pieces together and to allow the header area to stand above the product.

19 Claims, 5 Drawing Sheets

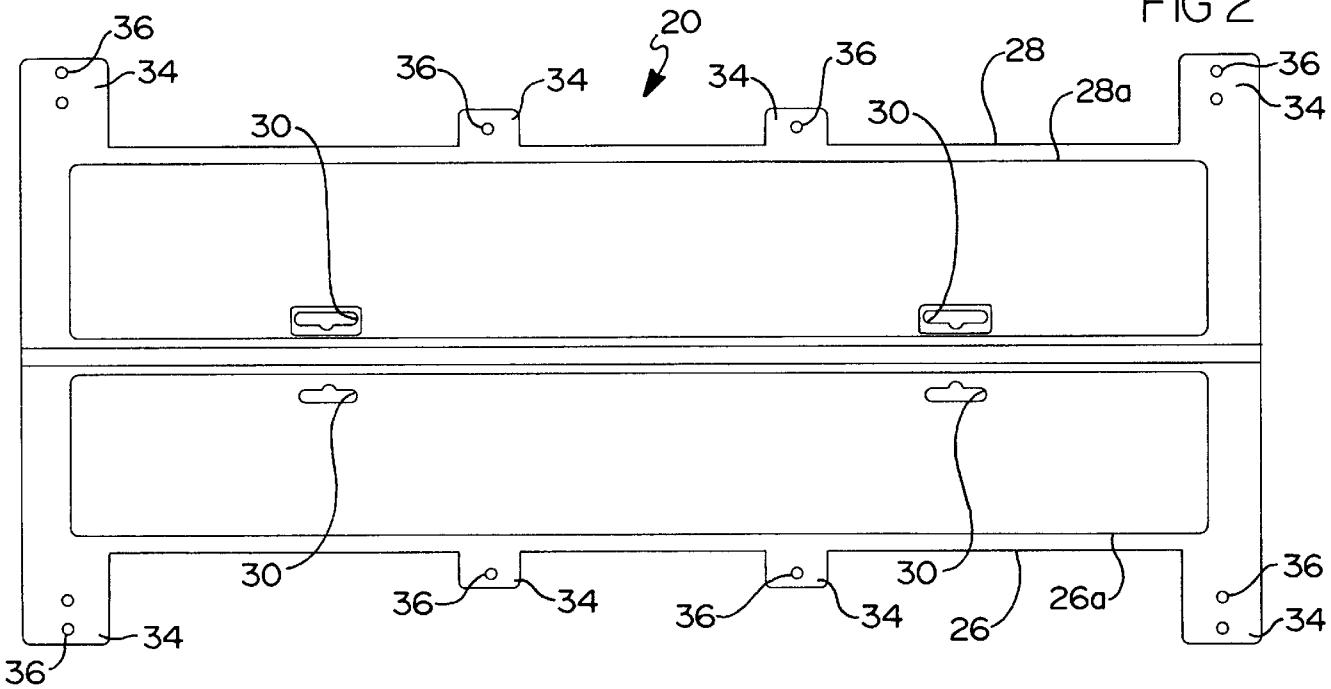
FIG 2
FIG 4
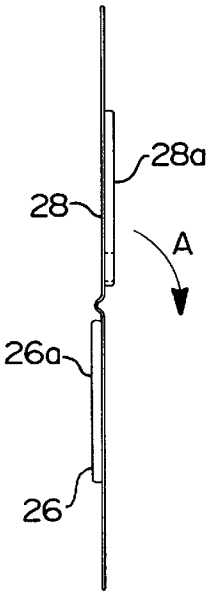
FIG 3

FIG 5
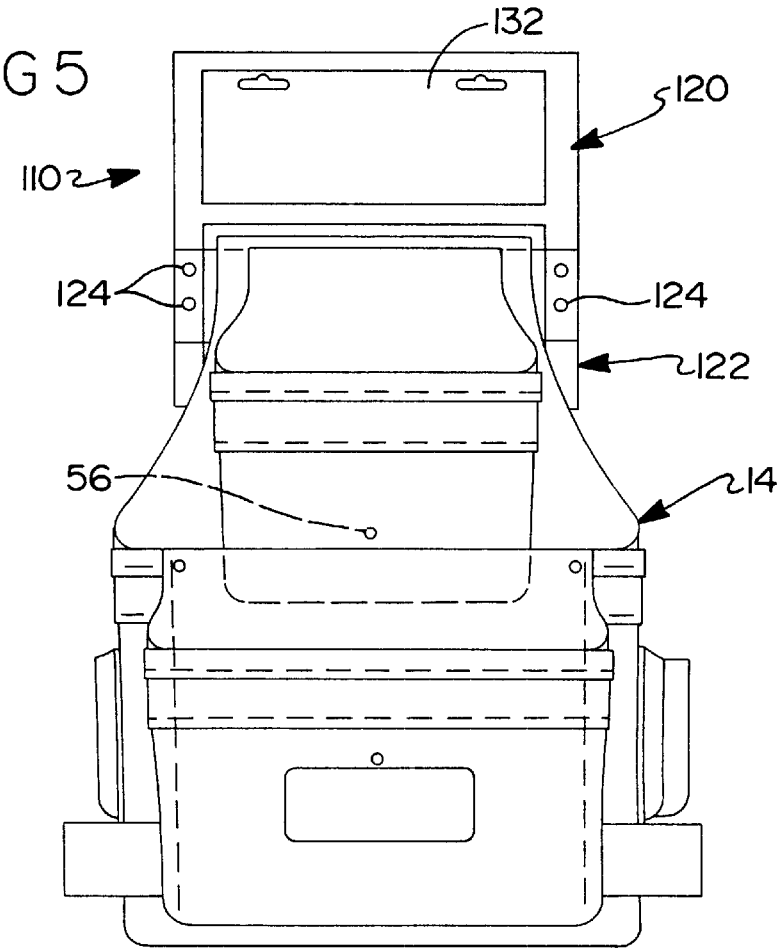
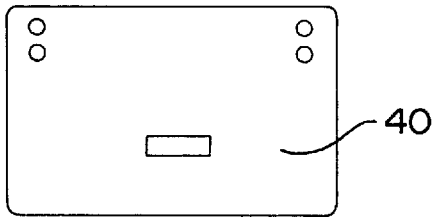
FIG 9
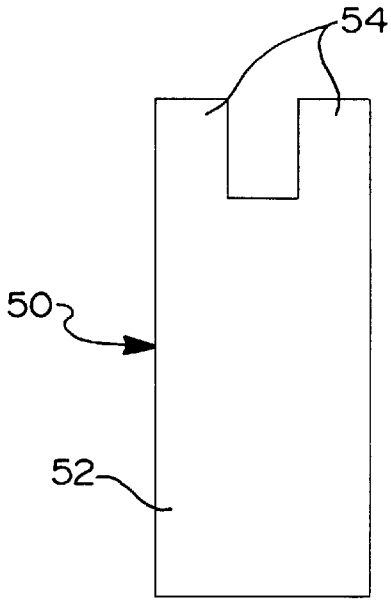
FIG 14

FIG 6
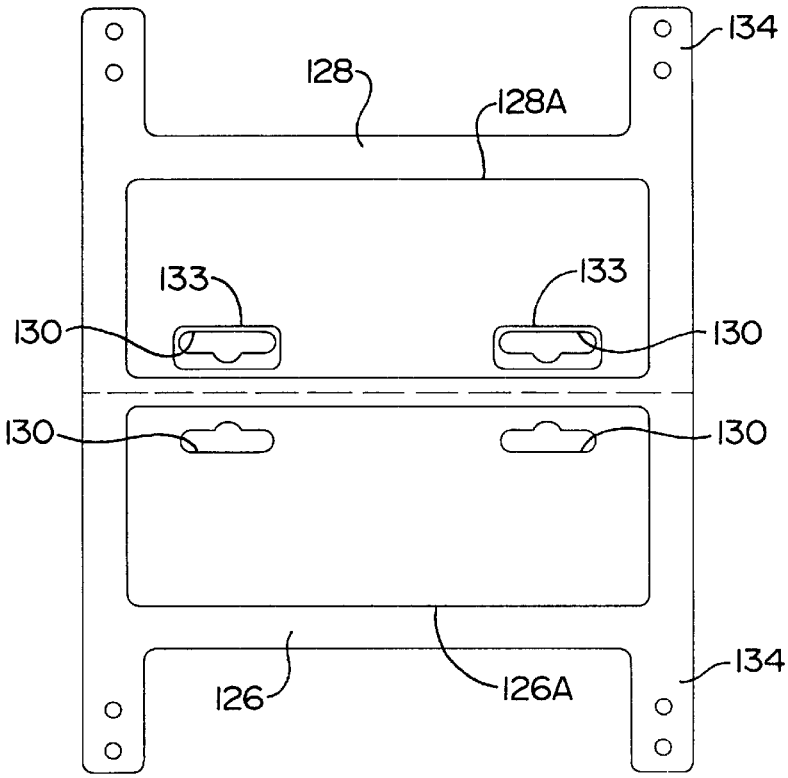
FIG 7
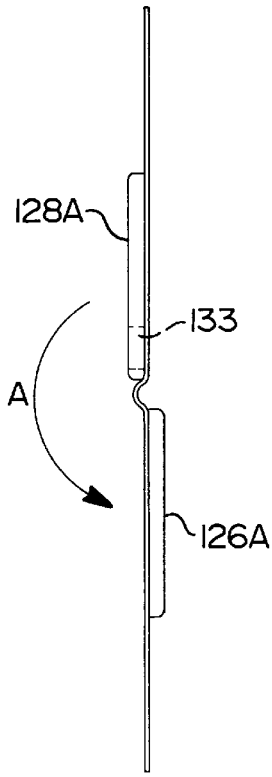
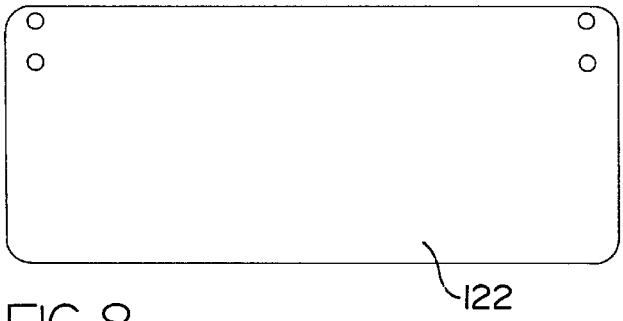
FIG 8

FIG 10
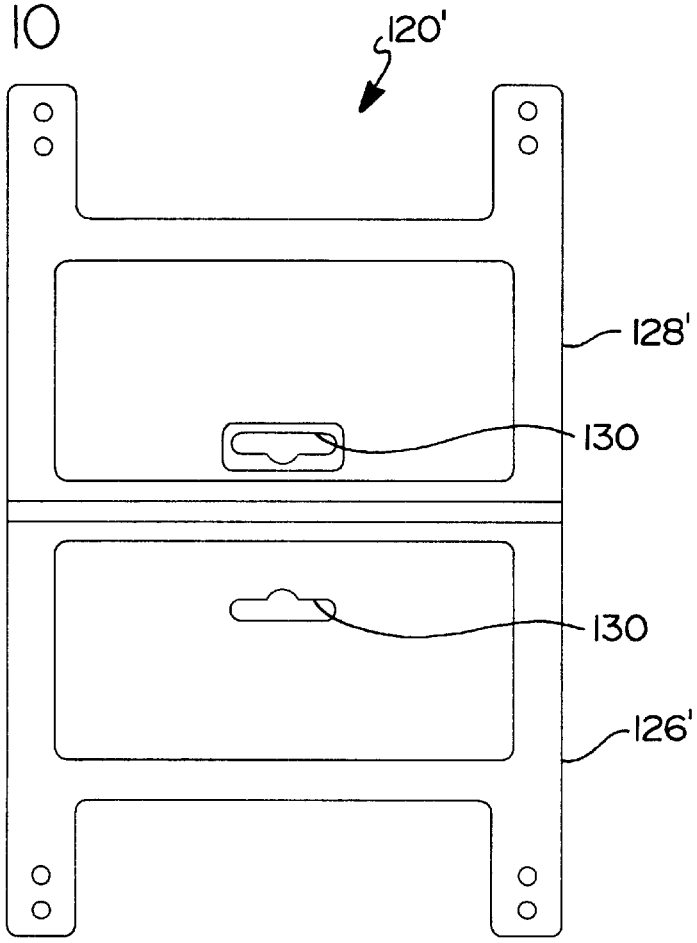
FIG 11
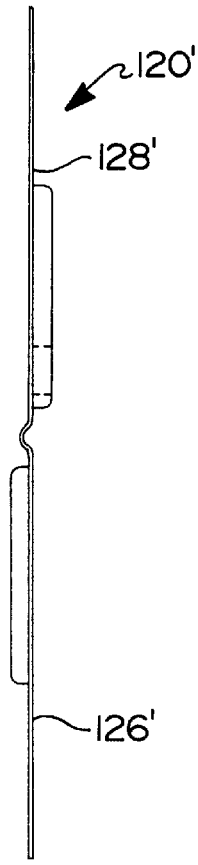
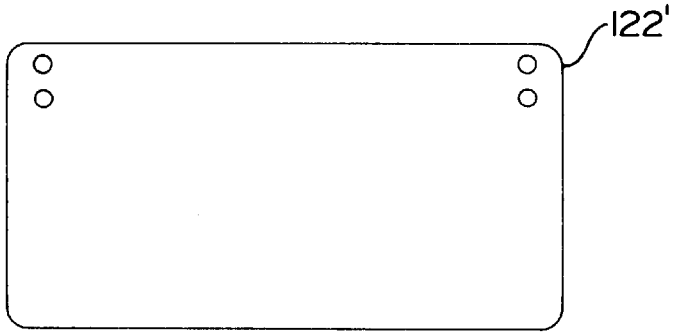
FIG 12
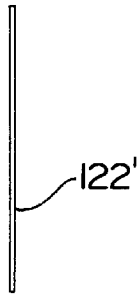
FIG 13

THERMOFORMED HEADER PACKAGE FOR TOOL BELT ACCESSORIES AND RELATED PRODUCTS

BACKGROUND OF THE INVENTION

1. Field of the Invention

The present invention relates to a display device for tool belt accessories and related products and more particularly, to a thermoformed header package for tool belt accessories and related products.

2. Background and Summary of the Invention

Tool belts are commonly used throughout the construction industry. Various accessories such as tool pouches, fastener pouches and hammer holders are typically supported by the tool belt. The present invention is directed toward providing a display device for effectively displaying and communicating the features and benefits of the tool belt product because current methods result in disorganized displays at retail which challenge consumers to located product information and limits off-shelf execution. Current methods of packaging such products consists of printed paperboard tags which are stapled to or otherwise attached to the products and result in poorly appearing merchandising.

In order to overcome the disadvantages of the prior display techniques the present invention provides a thermoformed header that attaches to the belt loop portion of the product. The thermoformed header contains performed hanger holes, a compartment for containing printed materials, and an area in which to place electronic surveillance devices. The thermoformed header consists of two pieces. The first piece is a main header portion which extends beyond the top of the product being packaged, and folds over onto itself and snaps together to trap a printed paper board card within. The header portion contains pre-formed hang holes for use with various merchandising systems including pegboard. The second thermoformed piece consists of a flat sheet that slips through the belt loop portion of the product being packaged, and is fastened to the main header portion by means of plastic push type fasteners to securely fasten the two pieces together and to allow the header area to stand above the product.

The thermoformed header package provides a large, clear area to contain printed material prominently displayed above the product for communicating product features and benefits to consumers. The thermoformed header package also includes pre-formed hang holes for displaying the product at retail. The thermoformed header package also provides tamper evidence since the packaging materials cannot be easily removed without damaging the thermoformed pieces or disassembling and removing the fasteners. The thermoformed header package also provides a hidden surface under the belt loop of the product in which to place electronic tagging devices (sensor tags) on the second thermoformed piece. Finally, the thermoformed header package provides a means for retailers to display the product in many different merchandising vehicles, such as pegboards, case cuts and wire formed racks.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 2 is a plan view of a main header portion of the display device of FIG. 1;

FIG. 3 is an end view of the main header portion shown in FIG. 2.

FIG. 4 is a plan view of a second header portion of the display device shown in FIG. 1;

FIG. 5 is a front view of a display device for a single tool pouch according to the principles of the present invention;

FIG. 6 is a plan view of the main header portion of the display device shown in FIG. 5;

FIG. 7 is a side view of the main header portion shown in FIG. 6;

FIG. 8 is a plan view of a second header portion of the display device shown in FIG. 5;

FIG. 9 is a plan view illustrating a sensor disposed on the second header portion of the display device according to the principles of the present invention;

FIG. 10 illustrates a plan view of a main header portion having a single hanger hole according to an alternative embodiment of the present invention;

FIG. 11 is an end view of the main header portion shown in FIG. 10;

FIG. 12 is a plan view of a second header portion for use with the main header portion shown in FIG. 10;

FIG. 13 is a side view of the second header portion shown in FIG. 12; and FIG. 14 is a plan view of a spine insert according to the present invention.

DETAILED DESCRIPTION OF THE PREFERRED EMBODIMENTS

Figure 1:
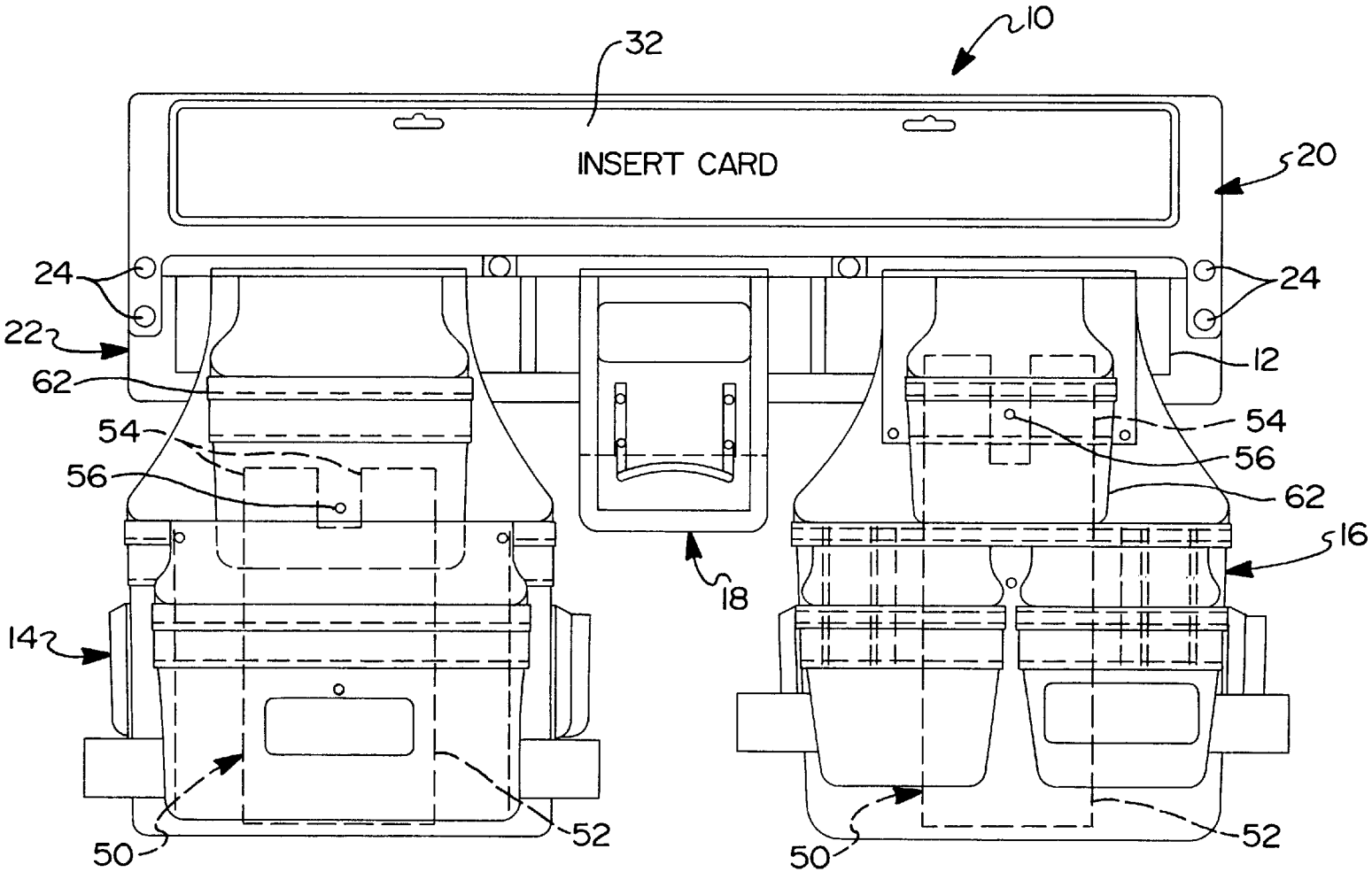
FIG. 1 is a front view of a display device for displaying a work belt and accessories accord principals of the present invention.

With reference to FIGS. 1–4, a first embodiment of the present invention will now be described. As shown in FIG. 1, a display device 10 is provided for displaying a work belt 12 including a nail pouch 14, a tool pouch 16 and a hammer holder 18. The display device 10 includes a main header 20 and a second header 22 attached to the main header by a plurality of fasteners 24.

As shown in FIGS. 2 and 3, the main header 20 is made from a unitary piece of clear plastic which forms a front panel 26 and a rear panel 28. The front and rear panels are each provided with pre-formed hang holes 30. The front panel 26 and rear panel 28 are also provided with projecting chamber portions 26*a*, 28*a* which engage one another to form a display chamber therebetween when the rear panel 28 is folded in the direction of arrow A in FIG. 3. An insert display card such as a printed paperboard card 32 is encapsulated within the display chamber. The printed paperboard card 32 is provided to communicate product features and benefits to consumers.

In the embodiment shown in FIGS. 1–4, the product being displayed is a work belt 12 including a nail pouch 14, a tool pouch 16 and a hammer holder 18. The work belt 12 is threaded through a belt loop portion of each of the nail pouch 14, tool pouch 16 and hammer holder 18 and is looped around behind and buckled. The second header portion 22 includes a flat sheet of clear plastic that slips through the belt loop portion of the nail pouch 14, hammer holder 18 and tool pouch 16 and is fastened to the main header 20 by plastic push type fasteners 24 to securely fasten the two pieces together and to allow the header area to stand above the product. As shown in FIG. 2, the main header 20 includes a plurality of projecting portions or legs 34 which are provided with fastener holes 36 which align with corresponding fastener holes 38 provided in the second header 22. The second header 22 is provided with two legs 39 adapted to be disposed on opposite sides of hammer holder 18 and including fastener holes 38 therein. The second header 22 is received between the legs of the front and rear panels 26, 28.

The display device 10 provides a large, clear area to contain printed materials 32 prominently displayed above the product for communicating product features and benefits. The main header 20 contains pre-formed hang holes 30 for displaying product in a retail store. The display device 10 also provides tamper evidence since the packaging materials cannot be easily removed without damaging the thermoformed piece or disassembling and removing the fasteners 24. A sensor tag or other electronic tagging device 40 can be provided on the second header 22 and provides a hidden surface under the belt loop portion of one of the pouches or hammer holder in which to place the sensor tag. In addition, the display device 10 provides a capability for retailers to display the product in many different merchandising vehicles such as pegboards, case cuts, wire formed brackets, etc.

It should be noted that although the present invention discloses the use of fastener holes 36 and 38 for receiving plastic fasteners 24, alternatively, these performed holes can be eliminated and staples or other fastening means such as heat staking and rivets can be utilized for holding the main header 20 and second header 22 together.

FIGS. 5–9 illustrate a display device 110 according to a second embodiment of the present invention which is designed for holding just a single nail pouch 14 or the like for display. The display device 110 according to this embodiment also includes a main header 120 and a second header 122 which is attached to the main header by plastic fasteners 124. In this embodiment, the main header 120 is provided with projecting portions or legs 134 disposed at opposite ends of the main header for attaching to the second header 122 on opposite sides of the nail pouch 14 in the same manner as described above. The main header 120 is again provided with front and rear panels 126, 128 which each form projecting chamber portions 126A, 128A which engage one another to define a display chamber therebetween for receiving a display insert card 132, as shown in FIG. 5. The main header 120 is also provided with performed hang hole 130. As shown in FIGS. 6 and 7, the areas 133 around the hang holes 130 provided in the back panel 128 are raised relative to the projecting chamber portion 128A. Thus, the hang holes 130 in the back panel 128 are spaced a predetermined distance away from the hang holes 130 in the front panel and the raised areas 133 provide additional structural support around the hang holes 130.

FIGS. 10–13 illustrate the components of a display device for smaller articles wherein the display device is only provided with one hanging hole 130, but otherwise has the same construction as the embodiment shown in FIGS. 5–9. The embodiment illustrated in FIGS. 10–13 include a main header 120' having a front panel 126' and a rear panel 128' and a second panel 122' which are shorter in length than the embodiment of FIGS. 5–9.

As illustrated in FIGS. 1 and 14, a spine insert 50 is inserted into the large main pocket 60 of the nail pouch 14 and tool pouch 16 to help the pouches 14, 16 stay upright and straight along the back which makes for a better appearing product. The spine insert 50 is preferably made from flat rigid plastic or cardboard and includes an elongated bottom portion 52, and a pair of upward extending legs 54 which are received behind the upper pocket 62 of the nail pouch 12 or tool pouch 14 on opposite sides of a rivet 56, which connects a rear portion of the upper pocket 62 to the back board portion 64 of the pouch. The spine insert 50 preferably is flexible enough to aid in inserting the insert into the main pocket 60 and behind the upper pocket 62 but rigid enough to support the backboard portion of the pouches 12, 14 in an upright or straight position.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A display device for an article, comprising:

a main header defining at least one hanging hole for hanging said display device, said main header including a front panel and a rear panel, projecting portions extending from said front and rear panels and disposed on opposite sides of a portion of the article; and a second header portion received through said article and connected to said projecting portions.

2. The display device according to claim 1, wherein said main header and said second header are connected to one another by a plastic fastener.

3. The display device according to claim 1, wherein said main header and said second header are stapled together.

4. The display device according to claim 1, wherein said main header is made from plastic clear plastic.

5. The display device according to claim 1, wherein said front and rear panels each include a projecting chamber portion which engage one another to define a display chamber therebetween.

6. The display device according to claim 5, further comprising an insert display card disposed in said display chamber.

7. The display device according to claim 1, wherein said main header includes a front and a rear panel pivotally connected to one another.

8. The display device according to claim 1, wherein said main header includes three projecting portions and said second header portion is connected to said three projecting portions of said main header.

9. A display device for articles, comprising:

a main header defining at least one hanging hole for hanging said display device and including a front panel and a rear panel each including a projecting chamber portion which engage one another to define a display chamber therebetween, projecting portions extending from said front and rear panels and disposed on opposite sides of a portion of the article;

a second header portion received through an opening in the article and connected to said projecting portions; and an insert display card disposed in said display chamber.

10. The display device according to claim 9, wherein said main header is connected to said second header by plastic fasteners.

11. The display device according to claim 9, wherein said main header is made from plastic and said projecting chamber portions of said front and rear panels are thermoformed.

12. The display device according to claim 9, wherein said front and rear panels of said main header are integrally formed from plastic.

13. The display device according to claim 9, wherein said main header is made from clear plastic.

14. The display device according to claim 9, wherein said main header and said second header are stapled together.

15. A display device for an article, comprising:

a main header defining at least one hanging hole for hanging said display device and three projecting portions adapted to be disposed on opposite sides of a portion of the article; and a second header adapted to be received through an opening in the article and connected to said three projecting portions of said main header.

16. A combined workbelt pouch and display device, comprising:

a workbelt pouch including a pouch portion connected to a belt loop portion;

a main header defining at least one hanging hole for hanging said display device and projecting portions disposed on opposite sides of the belt loop portion of the tool pouch; and a second header received through said belt loop portion in said workbelt pouch and connected to said two projecting portions of said main header.

17. The combined workbelt pouch and display device according to claim 16, further comprising spine support means inserted in said pouch portion of said workbelt pouch to support said workbelt pouch in a generally straight position.

18. The combined workbelt pouch and display device according to claim 16, wherein said main header includes a front and a rear panel, said front and rear panels each including a projecting chamber portion which engage one another to define a display chamber therebetween.

19. The combined workbelt pouch and display device according to claim 18, further comprising an insert display card disposed in said display chamber.

* * * * *